United States Patent [19]

Moss et al.

[11] 4,172,508

[45] Oct. 30, 1979

[54] EXHAUST SILENCERS

[76] Inventors: Leon C. Moss; Nicholas J. Stephenson, both of 10 School La., Baston, near Peterborough, Lincolnshire, England

[21] Appl. No.: 847,927

[22] Filed: Nov. 2, 1977

[30] Foreign Application Priority Data

Nov. 12, 1976 [GB] United Kingdom ..... 47151/76

[51] Int. Cl.[2] ..... F01N 1/08

[52] U.S. Cl. ..... 181/265; 181/270; 181/272

[58] Field of Search ..... 181/265, 264, 266, 267, 181/272, 275, 281, 231, 230, 270

[56] References Cited

U.S. PATENT DOCUMENTS

| | | | |
|---|---|---|---|
| 806,714 | 12/1905 | Porter | 181/265 |
| 1,490,957 | 4/1924 | Birger | 181/265 |
| 1,778,101 | 10/1930 | Bie | 181/265 |
| 1,828,110 | 10/1931 | Haas | 181/265 |
| 1,866,004 | 7/1932 | Beamer | 181/265 |
| 3,651,888 | 3/1972 | Andres | 181/265 |
| 3,754,620 | 8/1973 | Foster et al. | 181/265 |

*Primary Examiner*—Stephen J. Tomsky
*Attorney, Agent, or Firm*—Schwartz & Weinrieb

[57] ABSTRACT

An exhaust silencer comprising a primary exhaust gas expansion chamber, a secondary exhaust gas expansion chamber having a greater volume than said primary expansion chamber, an acoustically tuned length of exhaust pipe leading from the primary expansion chamber to the secondary expansion chamber and representing the only outlet from said primary expansion chamber and the only inlet to the secondary expansion chamber, an outlet pipe leading from the secondary chamber and surrounding said exhaust pipe with clearance between said pipes, and a further pipe surrounding said outlet pipe with clearance between said pipes, the outlet pipe and the said further pipe being perforated along at least part of their lengths.

7 Claims, 2 Drawing Figures

EXHAUST SILENCERS

BACKGROUND OF THE INVENTION

This invention relates to silencers for use in vehicle exhaust systems and aims to provide an improved silencer having a high degree of exhaust noise reduction with minimal engine power loss.

In order to achieve maximum exhaust assistance to improve the power output of a multi-cylinder engine, it is known to use an exhaust system having primary pipes of a tuned length which discharge into a small primary chamber from which a secondary pipe of related length discharges to atmosphere or into a secondary chamber for silencing purposes. Such a system is commonly called a "four into one" system when used on a four cylinder engine, a "three into one" system when used on a three cylinder engine, etc. Examples are to be found on racing car engines.

It has, however, proved difficult to use such systems on multi-cylinder motor cycle engines because on a motor cycle the exhaust system has to be arranged within a limited length.

SUMMARY OF THE INVENTION

The object of the present invention is to provide a silencer for use in an exhaust system which permits said exhaust system to be of minimal length and thereby suitable for use on a motor cycle although the system is not restricted to such use.

According to the invention, there is provided an exhaust silencer comprising a primary exhaust gas expansion chamber, a secondary exhaust gas expansion chamber having a greater volume than said primary chamber, an acoustically tuned length of exhaust pipe leading from the primary chamber to the secondary chamber and representing the only outlet from said primary chamber and the only inlet to said secondary chamber, an outlet pipe leading from the secondary chamber and surrounding said exhaust pipe with clearance between the pipes, and a further pipe surrounding said outlet pipe with clearance between the pipes, the outlet pipe and said further pipe being perforated along at least part of their lengths to permit the passage of exhaust gas therethrough. The perforated outlet pipe and further pipe thus take the form of tubular resonators.

Preferably, the acoustically tuned length of exhaust pipe is concentrically surrounded by the outlet pipe for a major portion of its length between the primary and secondary expansion chambers. The outlet pipe is in turn preferably concentrically surrounded by the said further pipe for a major portion of its length. The concentric layout of the pipes permits the silencer to have a minimal overall length and to be contained in a small total volume which is particularly advantageous where space is restricted, for example on a motor cycle.

The secondary chamber and the tubular resonators consisting of said outlet pipe and further pipe are preferably encased in a "megaphone" type envelope which is aesthetically desirable for a motor cycle unit. For cases in which the silencer is to be fitted to a multi-cylinder engine the primary chamber will not normally be encased in the "megaphone" type envelope but will serve as the connecting or "trouser" piece into which the primary exhaust pipes from the engine are fed. However, in the case in which the silencer is to be fitted to a single cylinder engine having a single exhaust pipe, the primary chamber may also be encased in the "megaphone" type envelope.

Primary exhaust pipes are normally tuned for length to make maximum use of the exhaust gas pulse energy. In the case of the silencer according to the invention, the secondary exhaust pipe leading from the primary expansion chamber to the secondary expansion chamber is acoustically tuned for length to match the power output of the engine for which the silencer is specifically designed.

BRIEF DESCRIPTION OF THE DRAWINGS

The invention will now be further described, by way of example, with reference to the accompanying drawings, in which.

In the drawings, like parts are denoted by like reference numerals.

DESCRIPTION OF PREFERRED EMBODIMENTS

Figure 1:
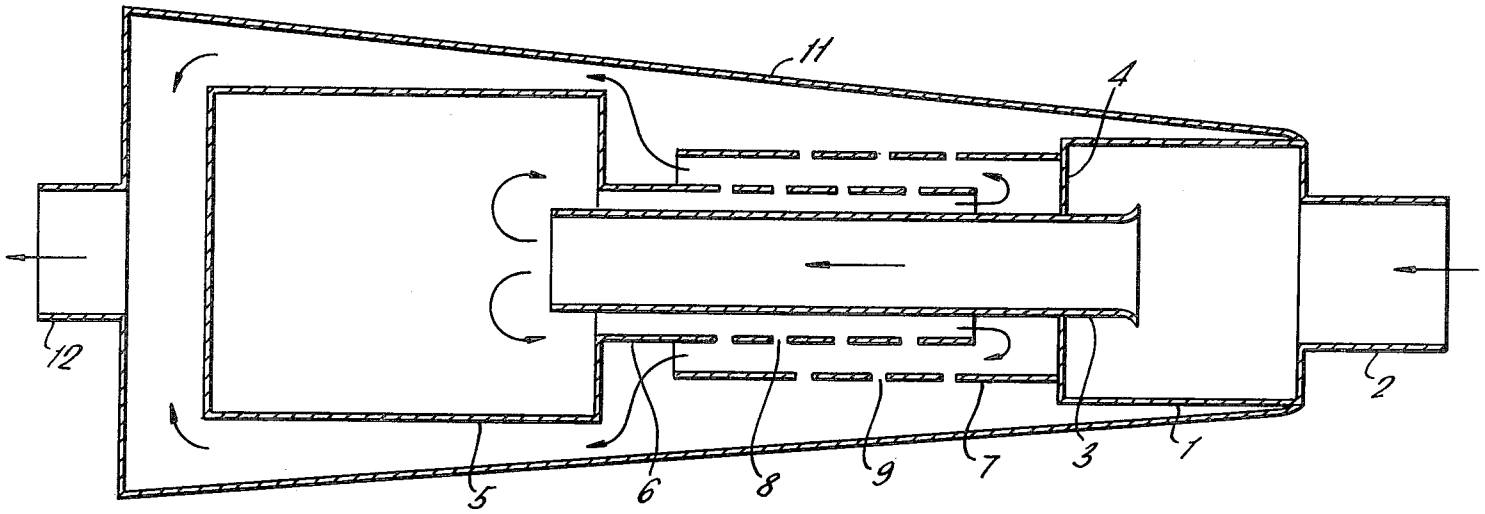
FIG. 1 is a section through one embodiment of a silencer according to the invention.

Reference will first be made to FIG. 1 of the drawings which shows a silencer for a single cylinder engine. The silencer comprises a primary expansion chamber 1 having an inlet flange 2 which is adapted to be fitted over the end of an exhaust pipe (not shown) and clamped thereto in known manner. One end of a pipe 3 extends into the primary expansion chamber 1 and is secured thereto, such as, for example, by welding, at the point at which said pipe passes through an end wall 4 of the chamber 1. The end wall 4 will normally be located opposite the inlet 2.

The other end of the pipe 3 extends into a secondary expansion chamber 5 which has a greater volume than the primary expansion chamber 1. An outlet pipe 6 leads from the secondary expansion chamber 5 and concentrically surrounds the pipe 3. The pipe 6 terminates short of the wall 4 of the primary expansion chamber 1 and is in turn concentrically surrounded by a further pipe 7 which is secured at one end to the wall 4 of the primary expansion chamber 1. The other end of the pipe 7 terminates short of the secondary expansion chamber 5 whereby a sinusoidal path is formed for escaping exhaust gases as indicated by the arrows in FIG. 1.

Perforations 8 and 9 are provided respectively in the pipes 6 and 7 over the portions of said pipes which overlap each other whereby said pipes comprise tubular resonators to muffle the exhaust noise.

To improve the appearance of the silencer which is particularly desirable if the silencer is to be used on a motor cycle, an outer case or megaphone envelope 11 may be fitted over the expansion chambers 1 and 5 to encase said chambers and the pipes 3, 6 and 8. The envelope is provided with an outlet pipe 12 to permit exhaust gases to escape.

Figure 2:
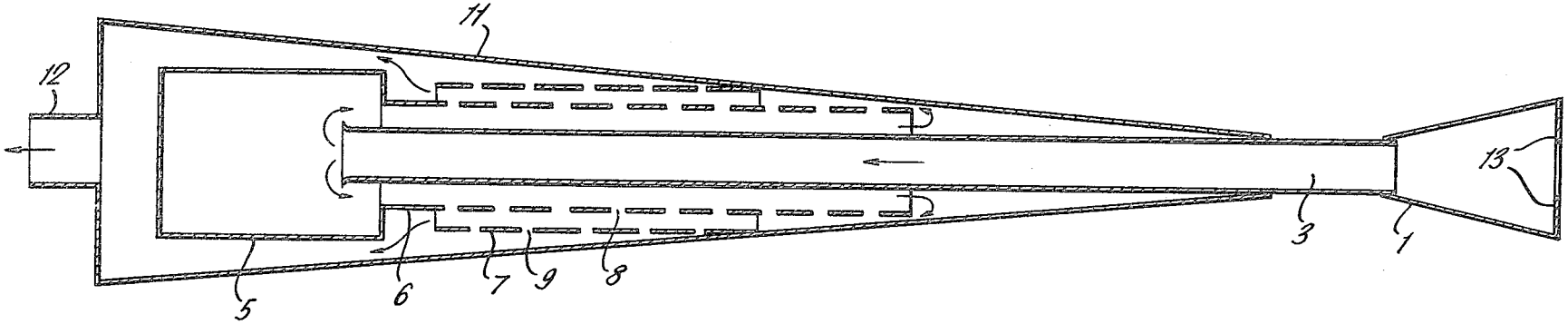
FIG. 2 is a section through a second embodiment of a silencer according to the invention.

The silencer shown in FIG. 2 is intended for a multi-cylinder engine. In this case, the primary expansion chamber 1 is provided with a plurality of inlet flanges 13 each of which is designed to fit over the end of a respective exhaust pipe from a respective cylinder of the engine (not shown). Furthermore, the pipe 7 is secured not to the primary expansion chamber 1 but to the megaphone envelope 11 and said envelope is secured to the pipe 3 and does not encase the primary expansion chamber 1. This silencer is otherwise substantially the same as the silencer shown in FIG. 1.

The volume of the two expansion chambers 1 and 5 and the length of the interconnecting pipe 3 will depend, for optimum performance and minimal power losses, upon such features as the unsilenced exhaust noise signature of the engine, exhaust gas volume flow rate and length of pipe connecting the engine to the primary expansion chamber. The design of the perforated tube resonators (that is, the diameter and spacing of the perforations and volume between the concentric tubes or pipes) will also depend on the above features. Thus, the actual dimensions and arrangement of the components forming the silencer according to the invention must be found by experiment for any particular engine.

Other embodiments and modifications are possible without departing from the scope of this invention as defined by the appended claims.

We claim:

1. An exhaust silencer comprising:

a primary exhaust gas expansion chamber, a secondary exhaust gas expansion chamber having a greater volume than that of said primary expansion chamber, an acoustically tuned length of exhaust pipe leading from the primary chamber to the secondary chamber and representing the only connection between said primary chamber and said secondary chamber, an outlet pipe leading from the secondary chamber and surrounding said exhaust pipe with clearance between said pipes, a further pipe surrounding said outlet pipe with clearance between said pipes, and means supporting said further pipe in spaced relation to said outlet pipe, the outlet pipe and said further pipe being provided with perforations along at least part of their lengths so as to permit the passage of exhaust gases therethrough.

2. An exhaust silencer as claimed in claim 1, in which said acoustically tuned length of exhaust pipe is concentrically surrounded by the outlet pipe for a major portion of its length between said primary and secondary expansion chambers.

3. An exhaust silencer as claimed in claim 1, in which said outlet pipe is concentrically surrounded by the said further pipe for a major portion of its length.

4. An exhaust silencer as claimed in claim 1, in which said secondary expansion chamber, said outlet pipe, the said further pipe and at least a portion of said acoustically tuned exhaust pipe are surrounded by an outer case or megaphone type envelope secured to said exhaust pipe.

5. An exhaust silencer as set forth in claim 1, wherein: said secondary expansion chamber, said outlet pipe, said further pipe, said acoustically tuned exhaust pipe, and said primary expansion chamber are surrounded by an outer casing secured to said primary expansion chamber.

6. An exhaust silencer as set forth in claim 1, wherein: the ends of said exhaust pipe which are fluidically connected to said primary and secondary expansion chambers extend into said expansion chambers a distance which is less than approximately one-half the axial length of said expansion chambers so as to facilitate the gas expansion and noise reduction effects, as well as eliminate high back pressure conditions with a consequent power augmentation.

7. An exhaust silencer as set forth in claim 1, wherein: said primary expansion chamber includes an inlet conduit for conducting said exhaust gases into said primary chamber, said conduit being substantially coaxial with said exhaust pipe and having a diametrical extent greater than that of said exhaust pipe yet less than that of said primary chamber.

* * * * *